US005883330A

United States Patent [19]

Yoshida

[11] Patent Number: 5,883,330

[45] **Date of Patent: *Mar. 16, 1999**

[54] AZODICARBONAMIDE CONTAINING GAS GENERATING COMPOSITION

[75] Inventor: Tadao Yoshida, Souka, Japan

[73] Assignees: Nippon Koki Co., Ltd., Tokyo; Daicel Chemical Industries, Ltd., Sakai; Otsuka Kagaku Kabushiki Kaisha, Osaka, all of Japan

[ * ] Notice: This patent issued on a continued prosecution application filed under 37 CFR 1.53(d), and is subject to the twenty year patent term provisions of 35 U.S.C. 154(a)(2).

[21] Appl. No.: 530,379

[22] PCT Filed: Feb. 10, 1995

[86] PCT No.: PCT/JP95/00192

§ 371 Date: Oct. 12, 1995

§ 102(e) Date: Oct. 12, 1995

[87] PCT Pub. No.: WO95/21805

PCT Pub. Date: Aug. 17, 1995

[30] Foreign Application Priority Data

Feb. 15, 1994 [JP] Japan ..... 6-018208
Feb. 15, 1994 [JP] Japan ..... 6-018209

[51] Int. Cl.[6] ..... C06B 29/08

[52] U.S. Cl. ..... 149/83; 149/36; 149/61; 149/77

[58] Field of Search ..... 149/36, 61, 83, 149/77

[56] References Cited

U.S. PATENT DOCUMENTS

| | | | |
|---|---|---|---|
| 3,811,358 | 5/1974 | Morse | 149/2 |
| 3,909,322 | 9/1975 | Chang et al. | 149/19.4 |
| 3,912,561 | 10/1975 | Doin et al. | 149/35 |
| 3,954,528 | 5/1976 | Chang et al. | 149/19.4 |
| 3,960,946 | 6/1976 | Dewitt etal. | 149/19.4 |
| 4,167,428 | 9/1979 | Sayles | 149/19.9 |
| 4,302,258 | 11/1981 | Fukuma et al. | 149/19.1 |
| 5,037,619 | 8/1991 | Alagy et al. | 422/191 |
| 5,125,684 | 6/1992 | Cartwright | 149/19.7 |
| 5,160,386 | 11/1992 | Lund et al. | 149/88 |
| 5,197,758 | 3/1993 | Lund et al. | 149/61 |
| 5,386,775 | 2/1995 | Poole et al. | 149/36 |
| 5,472,535 | 12/1995 | Mendenhall et al. | 149/36 |
| 5,472,647 | 12/1995 | Blau et al. | 149/109.6 |
| 5,482,579 | 1/1996 | Ochi et al. | 149/83 |
| 5,500,059 | 3/1996 | Lund et al. | 149/61 |
| 5,514,230 | 5/1996 | Khandhadia | 149/36 |
| 5,557,062 | 9/1996 | MacLaren et al. | 149/46 |
| 5,656,793 | 8/1997 | Ochi et al. | 149/22 |

*Primary Examiner*—Edward A. Miller
*Attorney, Agent, or Firm*—Armstrong, Westerman, Hattori, McLeland & Naughton

[57] ABSTRACT

A gas generating composition which is capable of significantly reducing the concentration of harmful gas components, particularly carbon monoxide, in the generated gas. Also a process for molding a gas generating composition in a suitable shape with high efficiency without a risk of explosion, fire or the like, the process being capable of producing a durable and firm molded gas generating composition.

The gas generating composition of the invention contains an oxide-based catalyst comprising at least two members selected from the elements of Groups I, IV, V, VI, VII and VIII in the periodic table in addition to the nitrogen-containing organic compound and the oxygen-containing inorganic oxidizing agent both essentially incorporated in the gas generating composition. The invention also provides a process for molding a gas generating composition, the process comprising the steps of adding 5 to 20% by weight of water to a gas generating composition essentially containing a nitrogen-containing organic compound and an oxyhalogen acid salt and further containing an oxide-based catalyst to give a wet mixture, granulating the wet mixture into wet granules, drying the wet granules to provide a discrete preparation and compression-molding the discrete preparation.

6 Claims, No Drawings

AZODICARBONAMIDE CONTAINING GAS GENERATING COMPOSITION

TECHNICAL FIELD

The present invention relates to a gas generating composition, and more particularly to an azide-free gas generating composition capable of burning for providing a gas to inflate an air bag for automotive use. The invention also concerns with a process for molding the gas generating composition and a method of storing and transporting the molded composition.

BACKGROUND ART

Air bag systems have been developed for automotive use. The air bag systems can quickly inflate an air bag with a gas generated from a gas generating composition to prevent the riders from being injured or killed by crashing, through inertia, against a steering wheel, a front windshield or other solid or hazardous parts in the automobile or the like in the event of collision of the automobile or the like running at a high speed. Gas generating compositions suitable for use with automotive air bag systems are to meet rigorous requirements. First, the air bag is required to be inflated in a very short time, usually within 30 to 50 milliseconds. Further, an optimum atmosphere in the bag corresponds in the composition to the air in the automobile or the like.

Currently available gas generating compositions containing an alkali metal salt or alkaline earth metal salt of hydrazoic acid, particularly sodium azide, as a gas generating base are able to meet the foregoing requirements and are good. However, these gas generating compositions have the drawback that the sodium azide as the main component and alkali components produced as by-products in the generation of a gas are toxic. Fears are entertained as to the environmental pollution entailed in the mass disposal of air bag system-loaded automobiles.

To overcome the foregoing problem, azide-free gas generating compositions have been developed as a substitute for sodium azide-based gas generating compositions. For example, Japanese Unexamined Patent Publication No.208878/1991 discloses a composition comprising tetrazole, triazole or a metal salt thereof as the main component, an oxygen-containing oxidizing agent such as ammonium perchlorate, sodium nitrate, etc., and a metallic oxide such as $V_2O_5$, CuO, $Fe_2O_5$, etc. Generally the air bag system is adapted to remove the undesired substances from the generated gas by filtration before the discharge of the gas into the bag. The role of the metallic oxide in the disclosed composition is to form a solid product of combustion which can be easily filtered. On the other hand, Japanese Examined Patent Publications Nos.6156/1989 and 6157/1989 disclose gas generating compositions comprising a metal salt of a hydrogen-free bitetrazole compound as the main component. Further, Japanese Unexamined Patent Publication No.213687/1993 discloses a gas generating composition comprising a transition metal complex of aminoarazole as the main component. The azide-free compounds taught in the foregoing series of prior art publications have the feature that carbon monoxide is produced in a low concentration because the compound has a small number of carbon atoms per molecule. But the disclosed compositions are all unsatisfactory in the time required for inflating the bag.

The inventor of the present invention previously found that an azide-free gas generating composition comprising, as active components, a specific nitrogen-containing organic compound such as azodicarbonamide and a specific oxygen-containing inorganic oxidizing agent such as potassium perchlorate is unlikely to cause environmental pollution and fully satisfactory in the bag-inflating time and is advantageous also in terms of costs. Then, the inventor filed patent applications on these findings (Japanese Unexamined Patent Publications Nos.32689/1994, 32690/1994 and 227884/1994). Such gas generating compositions produce remarkable results which are as follows.

(a) These compositions generate a large amount of a gas per unit mass, thereby contributing to the miniaturization of automotive air bag inflators and to the reduction of their weight. Forty grams of the gas generating composition suffices for a 60 l air bag in contrast with 60 to 80 g of conventional gas generating compositions required for the same bag.

(b) The compositions have the combustibility required of inflators. In a 60 l tank test, the compositions are equivalent to conventional gas generating compositions in the results plotted in a time/pressure curve.

(c) The compositions are prepared from low-toxicity compounds and thus are of lower toxicity themselves than conventional compositions.

(d) The compositions are prepared from low-hygroscopicity compounds and thus are of low hygroscopicity themselves. Thus, they can be more easily handled than conventional compositions.

(e) The gas and the suspended particulate substances produced by the combustion of the gas generating composition are relatively low in toxicity and lower in toxicity than those from conventional compositions. Accordingly the solid components of combustion product can be substantially completely removed by the filter used in conventional inflators.

(f) Even if an air bag-loaded automobile or transport vehicle carrying inflators should fall into water, spreading the composition in the water, a less damage would be done by the pollution than the case of conventional compositions.

(g) After the operation of an air bag, copper and potassium chloride predominantly remain as trapped by the filter in the inflator. These substances are unlikely to adversely affect the operators' health during the disassembly of air bag systems.

It is well known that in burning a carbon-containing organic compound, carbon monoxide is produced as an incompletely burned substance even if an oxidizing agent is used in an amount sufficient to generate an amount of oxygen essentially required for burning the carbon, hydrogen and combustible elements in the organic compound, namely even if it is used in excess of a stoichiometric amount. Consequently the nitrogen-containing organic compound such as azodicarbonamide which is a base for the gas generating composition is expected to produce a relatively large amount of carbon monoxide as a by-product on combustion of the compound particularly because of a great number of carbon atoms present per molecule of the compound.

An attempt may be made to use a catalyst useful in the conversion from carbon monoxide to carbon dioxide in order to avoid the production of carbon monoxide as a by-product. Numerous compounds are known as the catalyst as disclosed, for example, in "List 1 of Classification of Catalysts According to Reactions" (edited by Tarama Laboratory, Kyoto University, published by Kagaku Kogyo Sha, pp.291–292). But there is unknown a catalyst which can meet the reaction conditions of gas generating compositions for an air bag, that is, can exhibit an effective reactivity within a contact time of generally approximately tens of milliseconds.

DISCLOSURE OF THE INVENTION

A first object of the present invention is to provide a gas generating composition which is capable of significantly reducing the concentration of harmful gas components, particularly carbon monoxide, in the gas produced by the combustion of the composition.

A second object of the invention is to provide a process for molding a gas generating composition in a suitable shape with high efficiency without a risk of explosion, fire or the like, the process being capable of producing an endurable and firm molded gas generating composition.

A third object of the invention is to provide a method of storing, handling and transporting the molded gas generating composition with safety.

The first object of the invention can be achieved by adding an oxide-based catalyst undisclosed as useful for gas generating compositions in the foregoing prior art publications to the azide-free gas generating composition essentially containing the nitrogen-containing organic compound and the oxygen-containing inorganic oxidizing agent.

The second object of the invention can be achieved by adding 5 to 20% by weight of water to the gas generating composition essentially containing the nitrogen-containing organic compound and oxyhalogen acid salt and further containing an oxide-based catalyst comprising at least two members selected from the elements of Groups I, IV, V, VI, VII and VIII in the periodic table to give a wet mixture, granulating the wet mixture into wet granules, drying the wet granules to provide a discrete preparation and compression-molding the discrete preparation.

The third object of the invention can be achieved by placing the above obtained molded gas generating composition into a small-size container and accommodating the container into a heat-insulating container for packaging to provide insulation.

The inventor's research found the following. In molding the gas generating composition essentially containing the nitrogen-containing organic compound and oxyhalogen acid salt and further containing an oxide-based catalyst, the composition can be mixed with water in a much smaller amount than conventional compositions, i.e. about 5 to about 20% by weight, without a risk of explosion, fire or the like. Consequently a durable and firm molded gas generating preparation can be produced safely and efficiently without necessity of concentrating the mixture before granulation. The obtained molded gas generating preparation is placed in small amounts into a small-size container and the container is accommodated into a heat-insulating container for packaging to provide insulation, whereby the gas generating preparation can be stored, handled and transported with safety.

The gas generating composition of the invention contains an oxide-based catalyst comprising at least two members selected from the elements of Groups I, IV, V, VI, VII and VIII in the periodic table in addition to the nitrogen-containing organic compound and the oxygen-containing inorganic oxidizing agent both essentially incorporated in the gas generating composition.

Useful nitrogen-containing organic compounds are not specifically limited insofar as they are organic compounds having a nitrogen atom in the molecule. Examples of such organic compounds are amino group-containing organic compounds, amido group-containing organic compounds, nitramine group-containing organic compounds, nitrosoamine group-containing organic compounds, tetrazole derivatives, etc. Specific examples of amino group- or amido group-containing organic compounds are not critical and include, for example, azodicarbonamide, urea, aminoguanidine bicarbonate, biuret, dicyandiamide, hydrazides, etc. Useful hydrazides are acetohydrazide, 1,2-diacetylhydrazide, laurohydrazide, salicylohydrazide, oxalodihydrazide, carbohydrazide, adipodihydrazide, sebacodihydrazide, dodecanedihydrazide, isophthalodihydrazide, methyl carbazate, semicarbazide, formhydrazide, 1,2-diformyl-hydrazine and so on. The nitramine group-containing organic compounds that can be used are also virtually unlimited and include aliphatic and alicyclic compounds containing one or more nitramine groups as substituents, such as dinitropentamethylenetetramine, trimethylenetrinitramine (RDX), tetramethylenetetranitramine (HMX) and so on. The nitrosamine group-containing organic compounds that can be used are also virtually unlimited and include aliphatic and alicyclic compounds containing one or more nitrosamine groups as substituents, such as dinitrosopentamethylenetetramine (DPT). The tetrazole derivatives that can be used are also virtually unlimited and include aminotetrazole, tetrazole, azotetrazole, bitetrazole, tetrazolecarboxylic acid, alkali metal salts or alkaline earth metal salts thereof, etc. of which aminotetrazole is preferred. Among these nitrogen-containing organic compounds, azodicarbonamide has been used widely, for example, as a resin blowing agent or the like, and is of low fire-causing potential and low toxicity, hence, least likely to be hazardous in handling and particularly suitable. These nitrogen-containing organic compounds can be used either alone or in combination. Moreover, commercially available nitrogen-containing organic compounds can be used as they are. There is no limitation on, for example, the form and grain size of the nitrogen-containing organic compound and a suitable one can be selectively employed.

The oxygen-containing inorganic oxidizing agent to be used in this invention is selected from a broad range of conventional compounds such as nitrates, nitrites, oxyhalogen acid salts, etc. Specific examples of nitrates are potassium nitrate, sodium nitrate, strontium nitrate, potassium nitrate, etc. Useful nitrites are sodium nitrites, etc. Oxyhalogen acid salts are preferably halogenates and perhalogenates, more preferably alkali metal salts thereof. The alkali metal halogenates include chlorates and bromates such as potassium chlorate, sodium chlorate, potassium bromate and sodium bromate. The alkali metal perhalogenates include perchlorates and perbromates such as potassium perchlorate, sodium perchlorate, potassium perbromate and sodium perbromate. These oxygen-containing inorganic oxidizing agents may be used alone or in combination. Among these oxygen-containing inorganic oxidizing agents, at least one member selected from potassium nitrate, strontium nitrate and potassium perchlorate is preferred, and potassium perchlorate is more preferred.

The proportions of the nitrogen-containing organic compound and the oxygen-containing inorganic oxidizing agent are stoichiometric and sufficient to completely oxidize and burn the nitrogen-containing organic compound based on the amount of oxygen. The proportions can be suitably selected depending on the burning velocity, burning temperature, the composition of combustion products, etc. For example, the composition contains about 20 to about 400 parts by weight, preferably about 30 to about 200 parts by weight, of the oxygen-containing inorganic oxidizing agent, per 100 parts by weight of the nitrogen-containing organic compound. More preferably the oxygen-containing inorganic oxidizing agent is used slightly in excess of a stoichiometric amount sufficient to completely oxidize and burn the nitrogen-containing organic compound without marked reduction in the gas-producing efficiency per unit weight of the gas generating composition in order to further improve the effect of the oxide-based catalyst.

In the practice of the invention, the oxide-based catalyst comprising at least two members selected from the elements of Groups I, IV, V, VI, VII and VIII in the periodic table is incorporated into the gas generating composition essentially containing the nitrogen-containing organic compound and the oxygen-containing inorganic oxidizing agent. Among such oxide-based catalysts, preferred are those containing members selected at least from the elements of Groups IV, VI and VIII in the periodic table, more preferred is cobalt molybdate and/or lead molybdate, and most preferred is cobalt molybdate. Useful oxide-based catalysts include Co, Li, Na, K, Rb, Cs, Ag, Cu, Sn, Pb, V, As, Sb, Bi, Fe or Ni salts of molybdic acid, chromic acid and/or tungstic acid, etc.

The particle size of the oxide-based catalyst for use in the invention is not critical and is generally in the range of about 1 to 500 microns, preferably about 1 to about 100 microns, more preferably about 3 to about 50 microns. Ultra-fine particles of less than 1 micron in particle size are undesirable because of a great load on the filter during the filtration.

The content of the oxide-based catalyst in the gas generating composition of the invention is 1 to 20%, preferably 3 to 10% by weight, more preferably 3 to 7% by weight, based on the gas generating composition essentially containing the nitrogen-containing organic compound and the oxygen-containing inorganic oxidizing agent, or optionally based on the gas generating composition further containing a third component. A higher content of the oxide-based catalyst lowers the gas-producing efficiency per unit weight of the gas generating composition and is undesirable. On the other hand a lower content results in a difficulty in exhibiting the effect of reducing the concentration of harmful gas components and is undesirable.

The composition of the invention may further contain a binder for improving the molding strength of the composition, a promoter for promoting the decomposition of the nitrogen-containing organic compound, silica, etc. Useful binders include, for example, microcrystalline cellulose binders such as binders available under a trade name "AVICEL", polymer binders such as poval, organic binders such as starch, etc. Useful promoters for promoting the decomposition of the nitrogen-containing organic compound include a wide variety of oxide-based decomposition promoters, organic type decomposition promoters, etc. Specific examples of the oxide-based decomposition promoters are CuO, ZnO, $ZnCO_3$, $MnO_2$, $Pb_2O_3$, $Pb_3O_4$, $PbO_2$, PbO, S, $TiO_2$, $V_2O_5$, $CeO_2$, $B_2O_3$, $Ho_2O_3$, $CaO_2$, $Yb_2O_3$, etc. Useful organic type decomposition promoters include urea, etc.

The composition of this invention may contain, within the range not affecting its performance characteristics, at least one additive selected from the group consisting of burning control catalysts, antidetonation agents and oxygen-generating agents in addition to said two essential components.

The burning control catalyst is a catalyst for suitably adjusting the burning velocity, which is one of the basic performance parameters, according to the intended application, while fully retaining the safety parameters such as low shock ignition and non-detonation properties and other basic performance parameters such as the gas output. Such burning control catalysts include cellulosic compounds, and the chlorides, carbonates and sulfates of elements of Groups IV and VI in the periodic table such as $ZnCO_3$, $FeCl_3$, $Al_2(SO_4)_3$, $ZnSO_4$, $MnSO_4$, $FeSO_4$, etc. Among the cellulosic compounds mentioned above may be mentioned carboxy-methylcellulose, its ether, hydroxymethylcellulose, etc. These burning control catalysts can be used either alone or in combination. The amount of the burning control catalyst to be used is not critical and can be suitably selected from a broad range. Generally, however, this catalyst is used in an amount of about 0.1 to about 50 parts by weight, preferably about 0.2 to about 10 parts by weight, per 100 parts by weight of the total amount of the nitrogen-containing organic compound and oxyhalogen acid salt. The particle size of the burning control catalyst is not critical and can be appropriately selected.

The antidetonation agent is added for preventing the detonation which may occur when the gas generating composition is involved in a fire in the course of production, handling or transportation or is subjected to an extraordinary impact. As the addition of such antidetonation agent eliminates the risk of detonation, the safety of the gas-generating composition in various stages of production, handling and transportation can be further enhanced. As the antidetonation agent, known substances can be utilized. Thus, for example, oxides of bentonite, alumina, silica, diatomaceous earth, etc. and carbonates and bicarbonates of metals such as Na, K, Ca, Mg, Zn, Cu, Al, etc. can be mentioned. The amount of such antidetonation agent to be used is not critical and can be suitably selected from a broad range. Generally, it can be used in an amount of about 5 to about 30 parts by weight per 100 parts by weight of the total amount of the nitrogen-containing organic compound and oxyhalogen acid salt.

The oxygen-generating agent is effective in increasing the concentration of $O_2$ in the gas produced by the combustion of the composition. Useful oxygen generating agents are not specifically limited, and include conventional oxygen generating agents such as $CuO_2$, $ZnO_2$, etc. The amount of the oxygen generating agent to be used is not essential and, although selectable from a wide range, is usually in the range of about 10 to about 100 parts by weight per 100 parts by weight of the total amount of the nitrogen-containing organic compound and oxyhalogen acid salt.

The composition of the invention can be safely manufactured by mixing the components described above. While the resulting mixture per se may be used as the gas generating composition, preferably it may be provided in the form of a molded composition. Described below is a preferred process for molding the composition of the invention.

In the practice of the invention, the specific amounts of the components for the gas generating composition are weighed out. Added thereto is water in an amount of 5 to 20% by weight, preferably 10 to 20% by weight, based on the total amount of the components to give a wet mixture having a low deflagrating property and a low combustibility. Less than 5% by weight of water added is likely to contribute to propagation of a fire and detonation, whereas more than 20% by weight of water added enhances the flowability to excess, making it difficult to granulate the mixture. To make the molded product more endurable in this case, a binder such as a water-soluble starch, a polyvinyl alcohol, a partially saponified product thereof, etc. may be added in a suitable amount. The mixture may further contain an aggregate such as white carbon (fine particles of $SiO_2$) to smoothly mold the composition.

Then, the wet mixture is granulated into wet granules. There is no limitation on the grain size, but it is usually in the range of about 0.1 to about 4 mm in length, and about 0.4 to about 2.0 mm in diameter. The granulating method is not specifically limited, and the method conventionally used in the art may be employed. The granules thus obtained are heat-treated and can be used themselves as a gas generating composition.

The foregoing wet granules are dried and, optionally after being crushed and sieved, are compressed to obtain a discrete preparation. The drying is conducted at a temperature ranging from room temperature to about 110° C., preferably about 60° to about 90° C. to give granules having a water content of up to about 5% by weight, preferably up to about 2% by weight. The compression molding can be performed in the conventional manner. For example, the wet granules are compressed under a pressure of about 10 to about 5000 kgf/cm$^2$, preferably about 40 to about 2000 kgf/cm$^2$. The shape of the discrete preparation is not critical and includes, for example, a pellet, disk, ball, bar, hollow cylinder, confetti or tetrapod. It may be solid or porous (e.g. honeycomb-shaped). One or more projections may be formed on one surface of pellets or disks. The shape of projections is not critical and includes, for example, cylinders, cones, polygonal cones, polygonal pillars, etc.

In conducting the drying and compression-molding procedures, the wet granules and discrete preparation preferably remain in below a specific amount, usually up to 1 kg, after the transfer of processed product in order to further enhance the safety.

The discrete preparation is subjected to heat treatment, namely the final drying procedure, under the same temperature conditions as above, giving a firm molded product which is unlikely to become marred or fractured into pieces on exposure to a pressure or impact exerted from outside.

The thus obtained molded gas generating composition is charged, for example, in a suitable amount into a small-size container, which in turn is accommodated into a heat-insulating packaging container for insulation, whereby the molded composition can be safely stored since the molded composition would not be vigorously burned by exposure to a fire from outside and the fire can be easily extinguished, e.g. by pouring water in the event of ignition. A suitable amount of the pellets is usually in the range of about 20 to about 100 g, preferably about 40 g. There is no restriction on the materials to be used for the small-size container and the heat-insulating container for packaging. However, in view of economy, shelf life, transportability, etc. desirably the small-size container is made of polyethylene or like synthetic resins or aluminum, and the heat-insulating packaging container is made of foamed phenolic resins, foamed calcium silicate or like heat-insulating foamed materials.

According to the invention, the concentration of harmful components, particularly carbon monoxide, in the gas given off from the gas generating composition essentially containing the nitrogen-containing organic compound and the oxygen-containing inorganic oxidizing agent can be reduced to a range in which an automotive air bag system can be put to practical use.

Further, according to the invention, the gas generating composition essentially containing the nitrogen-containing organic compound and oxyhalogen acid salt can be efficiently molded into a suitable shape without a risk of explosion, fire or the like, and the resulting molded preparation is durable and firm. Furthermore, the obtained molded gas generating preparation can be safely stored and transported.

BEST MODE OF PRACTICING THE INVENTION

The invention will be clarified in more detail with reference to the following Examples and Comparative Examples. However, the invention is not limited at all to the Examples. The parts and percentages used in the following description are all by weight unless specifically indicated.

EXAMPLE 1

Thoroughly mixed together were powders of 45 parts of azodicarbonamide (hereinafter referred to as "ADCA"), 55 parts of potassium perchlorate, 10 parts of copper oxide, 1.1 parts of silica and 5 parts of cobalt molybdate. Further added was a 5% aqueous solution of water-soluble starch in an amount sufficient to provide a starch content of 0.55 part, followed by mixing, thereby producing a wet powder. The wet powder was adjusted to a particle size and a water content which were suited to molding. Using a hydraulic tablet molding machine, the powder was compressed under a pressure of about 120 kg/cm$^2$ to give pellets (9.7 mm in diameter and 4 mm high). Then the pellet sample was subjected to a specific tank test (by the methods disclosed in Japanese Examined Patent Publications Nos.3620/1977 and 6156/1989, etc.) using a chamber with a filter and a coolant to determine the concentration of carbon monoxide in the gas produced in the tank.

The sample was satisfactory in the values of the burning pressure and burning time. The sample was assayed by gas chromatography to determine the concentrations of carbon monoxide and carbon dioxide in the gas generated in the tank, which were 0.4 and 19.3%, respectively.

EXAMPLE 2

The concentration of carbon monoxide in the gas generated in the tank was determined in the same manner as in Example 1 with the exception of using 5 parts of lead molybdate in place of 5 parts of cobalt molybdate.

The obtained sample was similar in the values of burning pressure and burning time to the sample of Example 1. The concentrations of carbon monoxide and carbon dioxide in the gas generated in the tank were determined by assay through gas chromatography and were 0.5 and 18.9%, respectively.

EXAMPLE 3

The concentration of carbon monoxide in the gas generated in the tank was determined in the same manner as in Example 1 with the exception of using 5 parts of lead chromate in place of 5 parts of cobalt molybdate.

The obtained sample was similar in the values of burning pressure and burning time to the sample of Example 1. The concentrations of carbon monoxide and carbon dioxide in the gas generated in the tank were determined by assay through gas chromatography and were 0.5 and 15.9%, respectively.

COMPARATIVE EXAMPLE 1

The concentration of carbon monoxide in the gas generated in the tank was determined in the same manner as in Example 1 with the exception of not using 5 parts of cobalt molybdate.

The obtained sample was similar in the values of burning pressure and burning time to that of Example 1. The concentrations of carbon monoxide and carbon dioxide in the gas generated in the tank were determined by assay through gas chromatography and were 2.5 and 13.8%, respectively. Example 4 (Safety of the water-containing powder of the composition of the invention)

A BAM 50/60 steel pipe test was carried out according to "Recommendation on the Transport of Dangerous Goods—Tests and Criteria," First Edition, United Nations, New York, 1986, ST/SG/AC10/11. Stated more specifically, a mixture of 45 parts of ADCA powder (23 μm in mean particle size), 55 parts of potassium perchlorate (37 μm in mean particle size), 10 parts of copper oxide powder (2.5 μm in mean particle size), 1.1 parts of silica and 5 parts of cobalt molybdate (hereinafter called "present composition A") was admixed with 10%, 15% or 20% of water, and kneaded. Each mixture was placed into a steel pipe 50 mm in inner diameter, 60 in outer diameter and 500 mm in length. A device comprising 50 g of pellettype booster (RDX 95%, wax 5%) and having a No.6 electric detonator mounted atop was placed in the pipe, and the opening of the pipe was covered with a threaded cap. The steel pipe was horizontally buried under 50 cm of sand, and detonation was attempted. For comparison, the same test was conducted on a water-free molded product (dried product). Table 1 shows the results.

TABLE 1

| Water content (%) | Condition of steel pipe | Remaining component | Propagation |
|---|---|---|---|
| 0 (dried) | Destroyed into small pieces | None | Detonation propagated |
| 10 | Cracking in the pipe | None | Deflagration propagated |
| 15 | Pipe remaining unchanged | Present | Deflagration unpropagated |
| 20 | Pipe remaining unchanged | Present | Deflagration unpropagated |

Table 1 shows the following concerning the BAM 50/60 steel pipe test. The molded product of the invention containing 10% or more of water did not undergo the propagation of detonation, whereas the molded product of the invention containing 15% or more of water was not subjected to the propagation of deflagration. The term "detonation" used herein refers to a reaction producing vigorous evolution of combustion and involving a shock wave (propagating at a supersonic rate), and the term "deflagration" used herein means a reaction producing evolution of explosive combustion without involving a shock wave (propagating at an infrasonic rate).

A detonation test using a VP 30 vinyl chloride pipe was conducted according to the method of T. Okitsu et al. (Symp. Chem. Probl. Connected Stabil. Explos., 9th, 1992, p.107). Stated more specifically, a VP 30 vinyl chloride pipe (31 mm in inner diameter, 36 mm in outer diameter) was charged with 100 g of a mixture of the present composition A and 5%, 10% or 15% of water. A No.6 detonator was fitted in the pipe, and the pipe was buried in the sand, followed by detonation. After detonation, the remnants were checked for the propagation or non-propagation of detonation by checking the absence or the presence of craters, the absence or the presence of remaining components of the composition and the conditions of the vinyl chloride pipe. The results are shown in Table 2.

TABLE 2

| Water content (%) | Crater | Condition of vinyl chloride pipe | Remaining component | Propagation |
|---|---|---|---|---|
| 0 | Present | Destroyed into small pieces | None | Detonation propagated |
| 5 | Present | Destroyed into small pieces | None | Detonation propagated |
| 10 | None | Pipe remaining unchanged | Present | Detonation unpropagated |
| 20 | None | Pipe remaining unchanged | Present | Detonation unpropagated |

Table 2 shows that the powdery composition of the invention containing 10% or more of water underwent no propagation of detonation in the detonation test using a VP 30 vinyl chloride pipe.

A burning test was conducted in a tinplate pipe. Stated more specifically, a tinplate pipe 55 mm in diameter and 60 mm in height was charged with 40 g of a mixture of the present composition A and 10, 15 or 20% of water. Ignition was attempted by heating the upper part of the pipe using a nichrome wire. The results are shown in Table 3.

TABLE 3

| Water content (%) | Occurrence of ignition | Burning time | Propagation of fire | Start of Ignition attempt |
|---|---|---|---|---|
| 0 | Occurring | Continuously burned for 35 seconds | Fire propagated | Immediately after mixing |
| 10 | Unignited | — | Unpropagated | 1 day after mixing |
| 15 | Unignited | — | Unpropagated | Immediately after mixing |
| 20 | Unignited | — | Unpropagated | Immediately after mixing |

Table 3 shows that the composition of the invention containing 10% or more of water caused no propagation of combusition.

Judging from the results of the foregoing tests as a whole, the compositions of the invention incorporating 5 to 20% of water were remarkably improved in the safety against explosion and fire.

EXAMPLE 5

(Illustrating a safe process for preparing the molded composition of the invention)

Preparation of wet mixture

In 0.22 kg of water was dissolved 0.011 g of water-soluble starch. The solution was boiled for 5 minutes and left to stand for cooling. A mixing machine was charged with 0.90 kg of ADCA powder (23 μm in mean particle size), 0.20 kg of copper oxide powder (2.5 μm in mean particle size), 0.001 kg of silica and 0.02 kg of cobalt molybdate. The aqueous solution of starch prepared above was added to the mixture and was mixed for 30 minutes. The mixing machine was made to cease rotation and 1.10 kg of potassium perchlorate (37 μm in mean particle size) was added, followed by mixing for 30 minutes. The thus obtained wet mixture was subjected to a BAM 50/60 steel pipe test but induced no detonation.

Preparation and drying of wet granules

The wet mixture obtained above (0.5 kg) was granulated using a granulator having a nozzle orifice of 0.8 mm in diameter to give wet granules. One hundred grams of the wet granules was dried at 80° C. for 10 minutes, resulting in 0.5% of water remaining. On the other hand, 100 g of the wet granules were dried at 80° C. for 1 hour with the result that no water remained.

Preparation of pellets

Using a tablet molding machine, 80 g of the foregoing granules containing 0.5% of water was continuously compressed under a pressure of 40 kgf/cm$^2$ to provide pellets (6.0 mm in diameter, 2.0 mm thick). The pellet sample was dried at 80° C. for 1 hour and no water remained.

Filling the pellets into a small-size container

Forty gram portions of the pellets obtained above were each filled into polyethylene bottles 50 mm in outer diameter, 48 mm in height and 0.5 mm in thickness.

Accommodation of the small-size container with the pellets

The foregoing bottles each containing 40 g of pellets were placed in a container wherein the bottles were fitted into 25 circular cavities 50 mm in diameter and 50 mm in depth formed with spacing of 10 mm on a plate of foamed calcium silicate 300 mm in width, 300 mm in length and 65 mm in thickness. Two of such containers were placed in a corrugated cardboard box to thereby provide the gas generating preparation so packaged as to assure safety.

EXAMPLE 6

(Safety of wet granules of the composition of the invention)

Detonation test using a VP 30 vinyl chloride pipe

Samples were prepared from the wet granules obtained in Example 5 by adjusting them to a water content of 0%, 5% or 10%. The samples were subjected to a detonation test using a VP 30 vinyl chloride pipe with a No.6 detonator held therein. The results are shown in Table 4.

TABLE 4

| Water content (%) | Crater | Condition of vinyl chloride pipe | Remaining component | Detonation Propagation |
|---|---|---|---|---|
| 0 | Present | Destroyed into small pieces | None | Detonation propagated |
| 5 | None | Pipe remaining unchanged | Present | Unpropagated |
| 10 | None | Pipe remaining unchanged | Present | Unpropagated |

Burning test using a VP 30 vinyl chloride pipe

Samples were prepared from the wet granules obtained in Example 5 by adjusting them to a water content of 0, 5, 10, 12, 14 or 15%. One hundred gram portions of samples were each charged into a VP 30 vinyl chloride pipe 150 mm in length. Ignition was attempted by heating with a nichrome wire. The results are shown in Table 5.

TABLE 5

| Water content (%) | Occurrence of ignition | Burning time (sec.) | Propagation of fire | Remark |
|---|---|---|---|---|
| 0 | Occurring | 30 | Fire propagated | Flaming |
| 5 | Occurring | 208 | Fire propagated | Non-flaming |
| 10 | Occurring | 149 | Fire propagated | Non-flaming |
| 12 | Occurring | 240 | Fire propagated | Non-flaming |
| 12 | Occurring | — | Unpropagated | Spontaneously extinguished |
| 14 | Occurring | — | Unpropagated | Spontaneously extinguished |
| 15 | Unignited | — | Unpropagated | Unignited |

The granules of the composition of the invention containing 5% of water burned in a moderate degree, whereas no fire was propagated through the granules containing 14% of water.

United Nations—recommended burning test ("Recommendation on the Transport of Dangerous Goods" Sixth revised edition, United Nations, New York, 1989, ST/SG/AC. 10/1/Rev. 6)

Samples were prepared from the wet granules obtained in Example 5 by adjusting them to a water content of 0, 5 or 10%, and were each accumulated on a plate of heat-resistant inorganic material in the form of a prism-like mass 20 mm wide in the lower part, 10 mm high and 250 mm long. On heating one end of the mass using a nichrome wire, the water-free sample was ignited but immediately extinguished, whereas the sample containing 5% or 10% of water was not ignited. The results show that it is difficult for the fire to propagate through a small amount of granules in the case of using a small source of ignition.

EXAMPLE 7

(Safety of pellets of the composition of the invention)

The following tests were carried out using dried pellets and/or 5% water-containing pellets of the composition prepared in Example 5.

BAM 50/60 steel pipe test

A steel pipe 50 mm in inner diameter, 60 mm in outer diameter and 500 mm in length was loaded with 800 g of dried pellets. A device comprising 50 g of pellettype booster (RDX 95%, wax 5%) and having a No.6 electric detonator mounted atop was placed in the pipe, and the opening of the pipe was covered with a threaded cap. The steel pipe was horizontally buried under 50 cm of the sand, and detonation was attempted. The steel pipe was cracked, but was not broken into pieces. However, since the components of the composition did not remain, it was assumed that detonation occurred.

Detonation test using a VP 30 vinyl chloride pipe

Using 5% water-containing pellets and dried pellets each in an amount of 100 g, a detonation test was conducted in a VP 30 vinyl chloride pipe by attempting detonation with a No.6 electric detonator. In each test, remaining components were detected and the pipe was partially found. Thus, it was assumed that no detonation was propagated.

Burning test using a VP 30 vinyl chloride pipe

A VP 30 vinyl chloride pipe was charged with 100 g of 5% water-containing pellets or dried pellets. Ignition was attempted by passing an electric current at 27V and 5 A using a nichrome wire 0.5 mm in diameter to heat the pipe atop.

TABLE 6

| Water content (%) | Occurrence of ignition | Burning time (sec) | Propagation of fire |
|---|---|---|---|
| 0 | Occurring | 25 | Fire propagated |
| 5 | Occurring | 42 | Fire propagated |

The dried pellets and 5% water-containing pellets were able to propagate the fire when held in a container such as a VP 30 vinyl chloride pipe. However, the 5% water-containing pellets burned with exceedingly diminished intensity.

United Nations—recommended burning test

The dried pellets and 5% water-containing pellets were accumulated on a plate of heat-resistant inorganic material in the form of a prism-like mass 20 mm wide, 10 mm high and 250 mm long. One end of the mass was heated using a nichrome wire but the fire was not propagated through any of the prism-like masses.

Burning test using a drum of fibers

A 800 g quantity of dried pellets 9.7 mm in diameter and 4 mm in thickness was placed into a drum of fibers 300 mm in inner diameter and 450 mm in height. Ignition was induced by heating the drum from its coverless top with a nichrome wire. The pellets intensely burned for 9.5 seconds. The great amount of pellets vigorously burned in a discrete state within the container on ignition.

Burning test using a polyethylene bag

Dried pellets 9.7 mm in diameter and 4 mm in thickness were placed in a quantity of 100 g, 200 g, 400 g or 1600 g into a polyethylene bag. Ignition was induced by heating with a nichrome wire. The results are shown in table 7.

TABLE 7

| Amount of pellets (g) | Burning time (sec) |
|---|---|
| 100 | 20 |
| 200 | 22 |
| 400 | 15 |
| 1600 | 13 |

The results of the foregoing tests show that the dried pellets more vigorously burned in the container than otherwise and that the more the amount was, the more intensely the dried pellets burned.

Contagiously induced detonation test

A 40 g quantity of dried pellets was filled into each polyethylene bottle 50 mm in outer diameter, 30 mm in height and 0.5 mm in thickness. Nine of such bottles were arranged in a square form (3×3) so as to bring the bottles in contact with each other. The bottle disposed in the center of the arrangement was loaded with a No. 6 detonator and detonation was initiated. The dried pellets in the surrounding 8 bottles did not contagiously induce detonation.

Contagiously induced fire propagation test

A 40 g quantity of dried pellets was filled into each polyethylene bottle 50 mm in outer diameter, 30 mm in height and 0.5 mm in thickness. Nine of such bottles were arranged in a square form (3×3) so as to bring the bottles in contact with each other. The bottle disposed in the center of the arrangement was heated with a nichrome wire for ignition. Shortly the fire was propagated through the dried pellets in the eight bottles arranged around the central bottle.

The dried pellets placed in 40 g quantities dividedly in the polyethylene bottles burned with a pronouncedly lower intensity than the discrete pellets. Yet, the fire was propagated through the dried pellets in the bottles arranged in contact.

External fire test 1

A 40 g quantity of dried pellets was filled into each polyethylene bottle 50 mm in outer diameter, 30 mm in height and 0.5 mm in thickness. The bottles were accommodated in a corrugated cardboard box to pile up 27 of such bottles in three layers (each layer consisting of 9 bottles). The box was placed on a shelf and heated thereunder by burning kerosene. The dried pellets commenced burning 3.5 minutes after the ignition of kerosene, and continued to burn until temporarily ceasing burning in 17 seconds. In 30 seconds, the pellets resumed burning and vigorously burned for 25 seconds before extinction.

External fire test 2

A 40 g quantity of dried pellets was filled into each polyethylene bottle 50 mm in outer diameter, 48 mm in height and 0.5 mm in thickness. A pair of such bottles were disposed in a container wherein the bottles were fitted into two circular cavities 50 mm in diameter and 50 mm in depth formed with spacing of 10 mm on a plate of foamed calcium silicate 300 mm in width, 300 mm in length and 65 mm in thickness. Two of such containers holding the bottles were placed in a corrugated cardboard box as superposed in two layers. The box was placed on a shelf and heated thereunder by burning wood.

The pellets in the two bottles of the container retained in the upper position within the box began to burn 8 minutes after the ignition of wood due to a high heating power of the wood being burned. The other pellets commenced burning one after another by catching fire from adjacent pellets. The intensity of burning was moderate as compared with the burning in external fire test 1. Water was sprayed over the fire 4 minutes after the initial ignition and the fire was immediately extinguished. The pellets in the bottles of the container held in the upper position within the box were all burned out. Among the pellets in the bottles of the container held in the lower position within the box, only those in one bottle burned.

As apparent from the above, the dried pellets (pellet product) assure significantly improved safety against a fire when dividedly placed in small amounts in bottles which in turn are held in a heat-insulating container for insulation.

EXAMPLE 8

(Strength of the pellets of the invention)

Falling ball impact test 1 for impact strength of pellets

Sample 1: To 98 parts of the present composition A was added a solution of 2 parts of a polyvinyl alcohol-based binder (trade name "POVAL LA 50," product of Shin-Etsu Chemical Co., Ltd.) in 13 parts of water, followed by thorough mixing. The mixture was compressed under a pressure of 120 kgf/cm$^2$ using a mold capable of concurrently producing three pellets which were 9.7 mm in diameter and 4.6 mm high.

Sample 2: To 99.5 parts of the present composition A was added a solution of a polyvinyl alcohol-based binder (POVAL LA 50) in 0.5 part of water, followed by thorough mixing. The mixture was compressed under a pressure of 120 kgf/cm$^2$ using a mold capable of concurrently producing three pellets, and the following three types of pellets were produced:

a. 9.7 mm in diameter and 4.6 mm high b. 9.7 mm in diameter and 3.6 mm high c. 7.5 mm in diameter and 4.2 mm high Sample 3: The present composition A per se was compressed under a pressure of 120 kgf/cm$^2$ using a mold capable of concurrently producing three pellets which were 9.7 in diameter and 4.6 mm high.

Sample 4: Currently commercially available pellets of a sodium azide-copper oxide gas generating composition was used as such. The pellets were 5.0 mm in diameter and 2.6 mm high.

A falling ball impact tester (product of Kuramochi Kagaku Kikai Seisakusho, Yoshida et al. "SAFETY OF REACTIVE CHEMICAL SUBSTANCE AND AMMUNITION", p.116, published by Taisei Publishing Co., Ltd. (1998)) was used. To maintain the stability of a cylindrical roller made of steel 12 mm in diameter and 12 mm high, a protective cover was fitted around the cylinder. The test and assay were conducted by the Bluestone up-and-down method (W. J. Dixon and F. J. Masseg, "Introduction to Statistical Analysis," McGraw-Hill, Zud Edition, 1957, p.318). Among the tested pellets, damage-free pellets were regarded as "non-damaged" and those cracked or destroyed into pieces were regarded as "impaired".

The symbol $E_{50}$ used herein refers to the energy of falling balls capable of damaging 50% of pellets. The letter "σ" means a standard deviation of logE. Falling balls used in the test had a mass of 5.46 g or 32.6 g. The results are shown in Table 8.

TABLE 8

| Sample | Diameter (mm) | Thickness (mm) | Binder content (%) | Water content (%) | Heat-treatment (°C. × hr) | $LogE_{50}$ J | σ |
|---|---|---|---|---|---|---|---|
| 3 | 9.7 | 4.6 | 0 | 0 | — | −2.70 | 0.13 |
| 4 | 5.0 | 2.6 | — | 0 | — | −2.00 | 0.11 |
| 1 | 9.7 | 4.6 | 2.0 | 13 | — | −2.40 | 0.18 |
| 2 | 9.7 | 4.6 | 0.5 | 6 | — | −2.82 | 0.22 |
| 1 | 9.7 | 4.6 | 2.0 | 0 | 100 × 4 | −1.66 | 0.05 |
| 1 | 9.7 | 4.6 | 2.0 | 0 | 80 × 4 | −1.33 | 0.30 |
| 2 | 9.7 | 4.6 | 2.0 | 0 | 80 × 4 | −1.62 | 0.43 |
| 2 | 9.7 | 3.6 | 0.5 | 0 | 80 × 4 | −2.17 | 0.47 |
| 2 | 7.5 | 4.2 | 0.5 | 0 | 80 × 4 | −1.82 | 0.06 |

The results show the following. The pellets formed from the composition of the invention as mixed with an aqueous solution of a polyvinyl alcohol-based binder and heat-treated show a markedly high strength. The composition of the invention as mixed with an aqueous solution of a binder, pelletized and heat-treated is comparable or superior in strength to the pellets of conventional gas generating compositions (sodium azide-copper oxide compositions).

Falling ball impact test 2 (impact strength of pellets)

Mixed together were ADCA powder (23 μm in mean particle size), potassium perchlorate powder (37 μm in mean particle size), copper oxide powder (2.5 μm in mean particle size) and silica powder (0.03 μm in mean particle size) in the proportions shown in Table 9. Five parts of cobalt molybdate was added to the mixture. Added to the resulting mixture was an aqueous solution of a binder prepared by dissolving a binder in water in an amount of 5% of the entire amount, further adding water to give a 10% aqueous solution and boiling the solution for 5 minutes, whereby a wet mixture of the composition of the invention was produced.

TABLE 9

| No. | ADCA | $KClO_2$ | CuO | $SiO_2$ | Binder |
|---|---|---|---|---|---|
| 1 | 45 | 55 | 0 | 2.2 | 0.5 (Water-soluble starch) |
| 2 | 45 | 55 | 5 | 2.2 | 0.5 (Water-soluble starch) |
| 3 | 45 | 55 | 10 | 2.2 | 0.5 (PA-05) |
| 4 | 45 | 55 | 10 | 2.2 | 0.5 (SMR-10M) |
| 5 | 45 | 55 | 10 | 2.2 | 0.5 (C17) |
| 6 | 45 | 55 | 10 | 2.2 | 0.5 (PA-18) |

Note: PA-05, SMR-10M, C17 and PA-18 are all trade names for binders manufactured by Shin-Etsu Chemical Co., Ltd.

The foregoing wet mixtures were compressed under a pressure of 120 kgf/cm$^2$ using a mold capable of concurrently producing three pellets which are 10 mm in diameter and 5 mm high. The thus obtained pellets were heat-treated and dried at 80° C. for 1 hour and subjected to the same falling ball impact test as above. The falling balls used in the test had a mass of 32.6 g. The results are shown in Table 10.

TABLE 10

| No. | Binder | $LogE_{50}$ | σ |
|---|---|---|---|
| 1 | Water-soluble starch | −2.00 | 0.14 |
| 2 | Water-soluble starch | −2.20 | 0.01 |
| 3 | PA-05 | −2.04 | 0.05 |
| 4 | SMR-10M | −1.98 | 0.10 |
| 5 | C17 | −2.05 | 0.18 |
| 6 | PA-18 | −2.22 | 0.10 |

The addition of the binder and heat treatment as done above contribute to the production of pellets substantially equivalent in strength to the pellets of conventional compositions.

What we claim is:

1. A gas generating composition consisting essentially of an azodicarbonamide, an oxygen-containing inorganic oxidizing agent, and an oxide-based catalyst consisting essentially of at least one member selected from the group consisting of Co, Li, Na, K, Rb, Cs, Ag, Cu, Sn, Pb, V, As, Sb, Bi, Fe and Ni salts of molybdic acid, chromic acid and tungstic acid, the amount of the oxidizing agent being at least the stoichiometric amount necessary for oxidizing the azodicarbonamide.

2. The gas generating composition according to claim 1, wherein the oxide-based catalyst consists essentially of at least one member selected from the group consisting of Co, Sn, Pb, Fe and Ni salts of molybdic acid, chromic acid and tungstic acid.

3. The gas generating composition according to claim 2, wherein the oxide-based catalyst is cobalt molybdate and/or lead molybdate.

4. The gas generating composition according to any one of claims 1–3, wherein the oxygen-containing inorganic oxidizing agent is at least one member selected from the group consisting of potassium nitrate, strontium nitrate and potassium perchlorate.

5. The gas generating composition according to any of claims 1–3, wherein the oxygen-containing inorganic oxidizing agent is potassium perchlorate.

6. The gas generating composition according to claim 1, wherein the the oxygen-containing inorganic oxidizing agent is potassium perchlorate and the oxide-based catalyst is cobalt molybdate.

* * * * *